US008732975B2

(12) United States Patent
Rhodes et al.

(10) Patent No.: US 8,732,975 B2
(45) Date of Patent: May 27, 2014

(54) PIVOTALLY-DEPLOYABLE WORK SURFACE FOR A HOUSEHOLD APPLIANCE

(75) Inventors: Sam Rhodes, Ft. Lauderdale, FL (US); Oliver Schöne, New Bern, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 446 days.

(21) Appl. No.: 13/104,044

(22) Filed: May 10, 2011

(65) Prior Publication Data

US 2012/0285032 A1 Nov. 15, 2012

(51) Int. Cl.
*F26B 21/00* (2006.01)

(52) U.S. Cl.
USPC ..... 34/90; 34/105; 34/201; 68/19; 68/20; 8/137; D32/28; 211/1; 312/408

(58) Field of Classification Search
USPC ..... 34/90, 104, 105, 201; 68/240, 13 R, 5 C, 68/18 R, 19, 20; 8/137, 149, 159; D32/25, D32/28; 211/1, 2, 33; 269/309; 385/25, 147; 312/404, 308, 408
See application file for complete search history.

(56) References Cited

U.S. PATENT DOCUMENTS

| | | | | |
|---|---|---|---|---|
| 2,761,751 | A * | 9/1956 | Stockton | 312/274 |
| 3,636,299 | A * | 1/1972 | Stewart, Jr. | 219/201 |
| 4,086,709 | A * | 5/1978 | Jackson | 34/90 |
| 5,570,642 | A * | 11/1996 | Lehrman | 108/47 |
| 5,577,823 | A * | 11/1996 | Maglinger | 312/404 |
| 7,278,229 | B1 * | 10/2007 | Fen | 38/137 |
| 7,313,933 | B2 | 1/2008 | Carey et al. | |
| 7,587,917 | B2 * | 9/2009 | Gilboe et al. | 68/240 |
| 7,735,345 | B2 | 6/2010 | Wright et al. | |
| 2007/0151307 | A1 * | 7/2007 | Gilboe et al. | 68/13 R |
| 2010/0064543 | A1 | 3/2010 | Helot | |
| 2012/0000086 | A1 * | 1/2012 | Browne et al. | 34/108 |
| 2012/0285032 | A1 * | 11/2012 | Rhodes et al. | 34/90 |

FOREIGN PATENT DOCUMENTS

| | | | |
|---|---|---|---|
| DE | 10223539 | A1 | 12/2003 |
| FR | 2626899 | A1 | 8/1989 |
| GB | 855965 | | 12/1960 |
| WO | 03035961 | A2 | 5/2003 |

OTHER PUBLICATIONS

Non patent literature search for reloving servers or lazy susans conducted by examiner on Jan. 17, 2014.*
Non patent literature image search reloving servers or lazy susans conducted by examiner Jan. 17, 2014.*

* cited by examiner

*Primary Examiner* — Steve M Gravini
(74) *Attorney, Agent, or Firm* — James E. Howard; Andre Pallapies

(57) ABSTRACT

A work surface device for a domestic household appliance and a household appliance having a work surface. The work surface device includes a housing having a cavity accessible by an opening formed in a sidewall of the housing, and a pivotally-deployable work surface supported by the housing at a pivot point, wherein the pivotally-deployable work surface is movable about the pivot point from a stored position within the cavity to a deployed position outside of the housing, and wherein the pivotally-deployable work surface has a planar upper support surface.

53 Claims, 11 Drawing Sheets

PIVOTALLY-DEPLOYABLE WORK SURFACE FOR A HOUSEHOLD APPLIANCE

FIELD OF THE INVENTION

The present invention is directed to a household appliance, and more particularly, to a household appliance including a pivotally-deployable work surface, and more particularly, to a pivotally-deployable work surface having a deployable hanger rod.

BACKGROUND OF THE INVENTION

A household appliance, such as a front-loading clothes washer, includes a housing having a door that provides access to a washing unit in the interior of the appliance housing. The washing unit includes a tub having a cylindrical washing drum rotatably mounted inside the tub. In operation, clothes or laundry are inserted into the washer through the door and placed in the rotating washing drum inside the tub. The household appliance wets the laundry to be washed with washing liquid and mechanically moves the laundry to release contaminants from the laundry. A drive system rotates the washing drum inside the tub about an axis of the drum. Similarly, a dryer includes a housing having a door that provides access to a drying unit in the interior of the appliance housing. In operation, the dryer dries the laundry in the drying unit.

A conventional translatably-deployable drawer or work surface may be stacked between (i.e., sandwiched between) laundry machines in a vertically stacked configuration, such as a stacked washer and dryer. The conventional translatably-deployable drawer or work surface commonly is a pull-out drawer (i.e., translatable drawer) that is mounted on conventional side rails. The pull-out drawer can be stored within the work surface and withdrawn from the work surface to provide additional surface area or storage of lightweight and compact items.

The conventional pull-out drawer or work surface commonly uses conventional side rails and mounting hardware to enable the drawer or work surface to be translatably deployable from a housing.

SUMMARY OF THE INVENTION

The exemplary embodiments of the present invention recognize that the conventional pull-out drawer or work surface may interfere with an available area for a consumer to access the household appliance or limit the area in front of the household appliance. Additionally, the conventional pull-out drawer provides limited flexibility to the consumer. Furthermore, the conventional pull-out drawer commonly requires multiple side rails and mounting hardware that may result in an increase material and labor costs.

These problems and others are addressed by the present invention, a first exemplary embodiment of which comprises a pivotally-deployable work surface for a household appliance, such as a laundry appliance. The exemplary work surface can be stored within a housing of a work surface for a top of a household appliance, within a housing of a stacking kit for stacking household appliances, or within the housing of the household appliance itself.

The pivotally-deployable work surface can be rotated from a stored position within the housing of the stacking kit, work surface, or appliance to a deployed position outside of the housing to provide a work surface, for example, for a consumer to fold clothing. For example, the pivotally-deployable work surface can be deployed by pivoting or rotating the work surface forward from within the housing about a pivot point that is located near a forward or front panel of the household appliance. The pivot point can be located near the forward upper corner of the household appliance, or alternatively, the pivot point can be located near the forward upper central area of the household appliance. In other embodiments, the pivot point can be located adjacent to a side edge of the household appliance.

By pivotally-deploying the work surfaces from the work surface housing, the work surfaces can provide additional work surface area while minimizing the interference with the central area in front of the laundry appliance, thereby increasing the work surface area of the appliance while providing access to the central area of the appliance for the consumer to add or remove laundry through the door of the appliance, or to fold laundry, etc.

The work surface may be shaped as a quarter of a circle when viewed from above in order to be capable of being rotated in and out of the housing of the stacking kit, work surface, or appliance. Alternatively, the work surface may be shaped as a half of a circle when viewed from above in order to be capable of being rotated in and out of the housing of the stacking kit, work surface, or appliance. The curved shape of the work surfaces can increase an amount of access area in the central portion between the work surfaces, which may improve access to the laundry appliance by the consumer.

The pivotally-deployable work surface and/or the housing of the work surface can include a deployable feature, such as a rod, bar, or the like for hanging clothes, hangers, etc., or an integrated feature, such as openings, slots, etc. for hanging clothes hangers. In this manner, the deployable or integrated feature can be stored along with the work surface when the work surface is in the stored position within the housing. When the work surface is deployed but the consumer does not need to hang laundry hangers, the deployable feature and/or the integral feature will not interfere with the consumer's access to the laundry appliance. When the work surface is deployed and the consumer desires to hang laundry hangers, the deployable feature and/or the integral feature can permit the consumer to hang laundry and/or laundry hangers from the housing or the work surfaces while minimizing or preventing interference with the use of the laundry appliance by the consumer.

An exemplary embodiment of the invention includes a work surface device for a domestic household appliance, the work surface device including a housing having a cavity accessible by an opening formed in a sidewall of the housing, and a pivotally-deployable work surface supported by the housing at a pivot point, wherein the pivotally-deployable work surface is movable about the pivot point from a stored position within the cavity to a deployed position outside of the housing, and wherein the pivotally-deployable work surface has a planar upper support surface. In an exemplary embodiment, the pivotally-deployable work surface includes a deployable feature for hanging items.

In another exemplary embodiment of the invention, the pivotally-deployable work surface includes a deployable feature for hanging items and/or an integral stationary feature for hanging items. The deployable feature can include an opening and/or a notch for receiving an end of a laundry hanger. The deployable feature can include an end cap for preventing one of laundry items and a laundry hanger from sliding off of the deployable feature.

Another exemplary embodiment of the invention includes a work surface device for a domestic household appliance, the work surface device including a housing having a cavity accessible by an opening formed in a sidewall of the housing, a pivotally-deployable work surface supported by the housing at a pivot point, wherein the pivotally-deployable work surface is movable about the pivot point from a stored position within the cavity to a deployed position outside of the housing, and wherein the pivotally-deployable work surface has a planar upper support surface, and a second pivotally-deployable work surface supported by the housing at a second pivot point, wherein the second pivotally-deployable work surface has a planar upper support surface.

Yet another exemplary embodiment of the invention includes a domestic household appliance including a housing having a door for accessing an interior of the housing, and a work surface device including a housing having a cavity accessible by an opening formed in a sidewall of the housing, and a pivotally-deployable work surface supported by the housing at a pivot point, wherein the pivotally-deployable work surface is movable about the pivot point from a stored position within the cavity to a deployed position outside of the housing, and wherein the pivotally-deployable work surface has a planar upper support surface. The domestic household appliance can include a second pivotally-deployable work surface supported by the housing at a second pivot point, wherein the second pivotally-deployable work surface has a planar upper support surface.

Other features and advantages of the present invention will become apparent to those skilled in the art upon review of the following detailed description and drawings.

BRIEF DESCRIPTION OF THE DRAWINGS

These and other aspects and features of embodiments of the present invention will be better understood after a reading of the following detailed description, together with the attached drawings, wherein.

DETAILED DESCRIPTION OF THE EXEMPLARY EMBODIMENTS OF THE INVENTION

Figure 2:
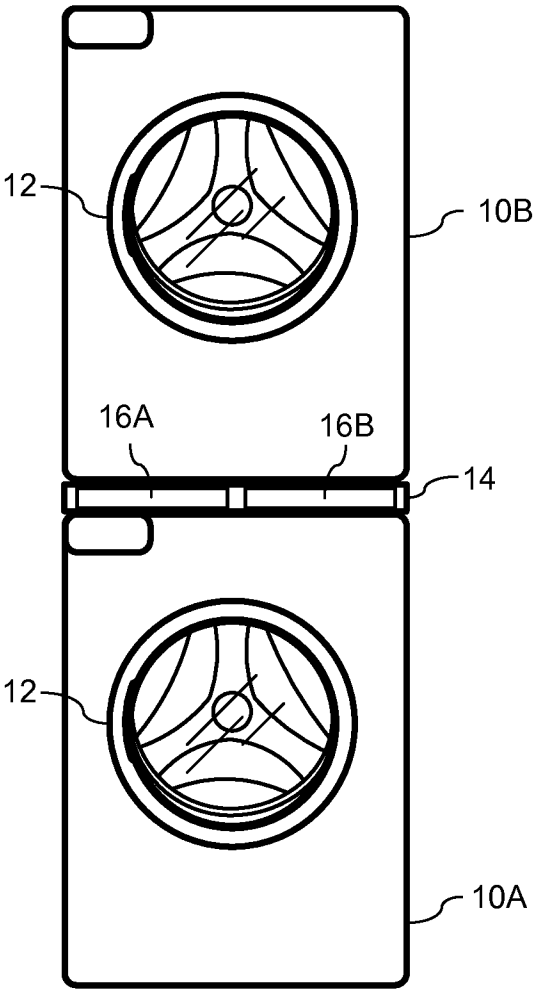
FIG. 2 is a front elevation view of a pair of stacked household appliances having a pivotally-deployable work surface according to an exemplary embodiment of the invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Referring now to the drawings, FIGS. 1-14H illustrate exemplary embodiments of a pivotally-deployable work surface for a domestic household appliance.

Figure 1:
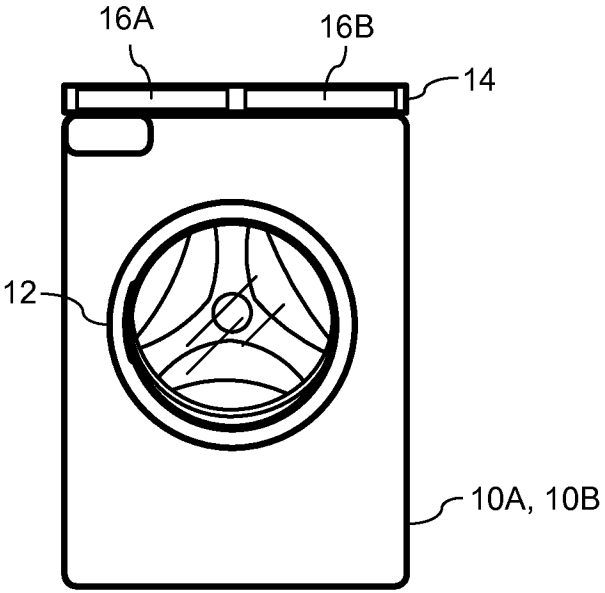
FIG. 1 is a front elevation view of a household appliance having a pivotally-deployable work surface according to an exemplary embodiment of the invention.

As shown in FIG. 1, a household appliance, such as a laundry appliance, includes a housing 10A, 10B having a door 12 for accessing the interior of the housing. The laundry appliance can be a washer (e.g., 10A) or a dryer (e.g., 10B). A work surface housing 14 can be provided on top of the laundry device 10A, 10B.

In a single appliance configuration, as illustrated in FIG. 1, the work surface housing 14 can increase a height of the effective upper work surface of the laundry appliance 10A, 10B. The work surface housing 14 can include one or more pivotally-deployable work surfaces 16A, 16B for increasing the work surface of the appliance. By pivotally-deploying the work surfaces from the work surface housing 14, the work surfaces 16A, 16B can provide additional work surface area while minimizing the interference with the central area in front of the laundry appliance, thereby increasing the work surface area of the appliance while providing access to the central area of the appliance for the consumer to add or remove laundry through the door 12 of the appliance 10A, 10B.

As shown in FIG. 2, the laundry appliance can be positioned in a stackable configuration, for example, with a dryer 10B stacked on top of a washer 10A. A work surface housing 14 can be configured as a stacking kit that interposes the dryer 10B and the washer 10A. The work surface housing 14 according to this exemplary embodiment can include a structural frame or reinforced frame suitable for supporting the overall load of the dryer 10B under operating conditions. The work surface housing 14 can include one or more pivotally-deployable work surfaces 16A, 16B for increasing the work surface of the appliances. By pivotally-deploying from the work surface housing 14, the work surfaces 16A, 16B can provide additional work surface area while minimizing the interference with the central area in front of the laundry appliance, thereby increasing the work surface area of the appliance while providing access to the central area of the appliance for the consumer to add or remove laundry through the door 12 of the appliance 10A, 10B.

Figure 4:
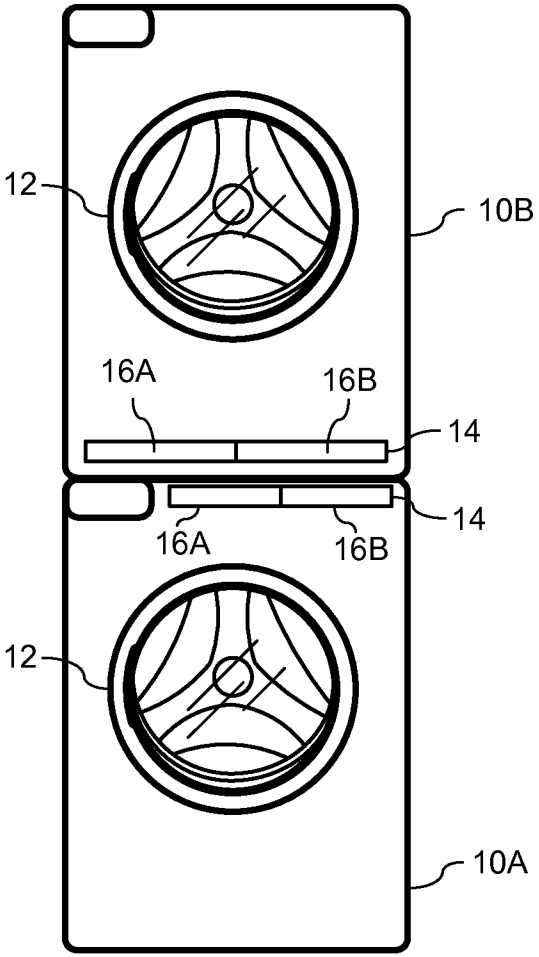
FIG. 4 is a front elevation view of a pair of stacked household appliances, each having an integral pivotally-deployable work surface, according to an exemplary embodiment of the invention.
Figure 3:
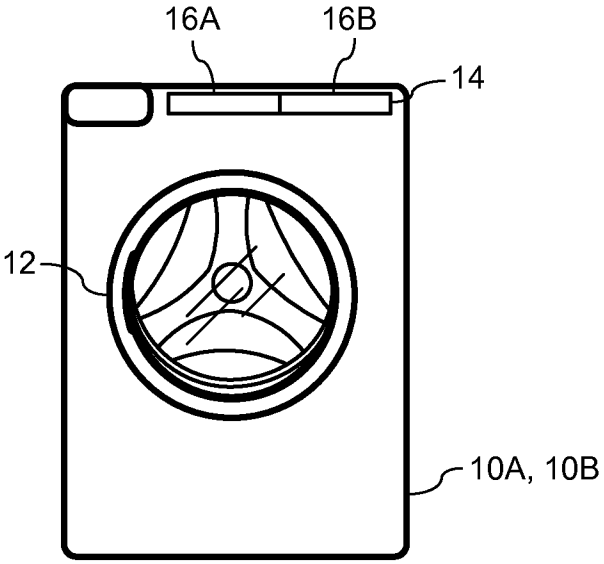
FIG. 3 is a front elevation view of a household appliance having an integrated pivotally-deployable work surface according to an exemplary embodiment of the invention.

As shown in FIGS. 2 and 3, the work surface housing 14 having one or more pivotally-deployable work surfaces 16A, 16B can be a separate unit that rests on top of the appliance 10A, 10B or is coupled to the top of the appliance 10A, 10B. In other embodiments, for example as shown in FIGS. 3 and 4, the work surface housing 14 having one or more pivotally-deployable work surfaces 16A, 16B can be integrally formed with the housing of the appliance 10A, 10B. The integrally formed work surface housing 14 can be formed adjacent to an upper surface of the appliance 10A, 10B, as shown in FIG. 3, Additionally or alternatively, as shown in FIG. 4, the integrally formed work surface housing 14 can be formed adjacent to a lower surface of the appliance (e.g., 10B), which is configured for a stackable arrangement. In this manner, the integrally formed work surface 14 formed in the lower portion of the stacked dryer 10B can provide additional work surface without interfering with the control panel, control devices, fluid containers such as washing fluid openings or trays, etc. of the washer 10A, which may commonly be located at the upper area of the washer 10A.

Figure 5:
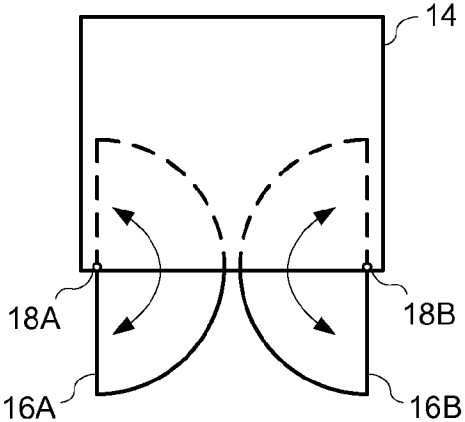
FIG. 5 is a top plan view of a household appliance having a quarter-circle pivotally-deployable work surface according to an exemplary embodiment of the invention.

With reference to FIG. 5, an exemplary embodiment of a work surface housing 16 having pivotally-deployable work surfaces 16A, 16B will now be described.

As shown in FIG. 5, the work surface housing 16 can include one or more pivotally-deployable work surfaces 16A, 16B that pivot or rotate from a stored position within the housing 16 to a deployed position outside of the housing 16. The work surfaces 16A, 16B can pivot about pivot points 18A, 18B that are located at outside corners of the housing 16 and adjacent to a front surface of the appliance 10A, 10B. In this manner, the work surfaces 16A, 16B can provide additional work surface, for example, for a consumer to fold laundry. As shown in FIG. 5, the curved shape of the work surfaces 16A, 16B, when viewed from above, facilitates the deployment of the work surfaces from the housing 14. The curved shape of the work surfaces 16A, 16B also provides an access area in the central portion between the work surfaces 16A, 16B, which may improve access to the laundry appliance by the consumer.

The work surface housing 14 and/or the work surfaces 16A, 16B can include one or more securing devices, such as a latch device, lock device, or clamp device that secures the work surfaces 16A, 16B in the deployed position, thereby improving the stability of the work surface 16A, 16B and preventing the work surfaces from pivoting back into the stored position or into a partially stored position. The work surfaces 16A, 16B can be configured to be securely positioned in a fully deployed position or a fully stored position. In other embodiments, the work surfaces 16A, 16B can be configured to be securely positioned in one or more intermediary, partially deployed/stored positions, or an infinite number of partially deployed/stored positions between the fully deployed position and the fully stored position, thereby providing a consumer with the ability to choose from a variety of positions and configurations.

The work surface housing 14 is not limited to the illustrated embodiments and can include other arrangements, such as an arrangement with a single work surface or an arrangement of three or more pivotally-deployable work surfaces. The work surfaces 16A, 16B can be pivotally-deployable from one or more sides of the housing 14. The work surfaces 16A, 16B are not limited to the illustrated embodiments and can include other shapes and sizes. For example, the work surfaces 16A, 16B can have a quarter-circle shape when viewed from above, or a half-circle shape when viewed from above. Other shapes also are contemplated. Each of the work surfaces 16A, 16B can be configured to have a different shape or the same shape. Each of the work surfaces 16A, 16B can be configured to have a different size or the same size.

The pivot points 18A, 18B between the housing 14 and the work surfaces 16A, 16B can be formed by conventional hinges, axles, pins, etc. that permit the work surfaces 16A, 16B to rotate or pivot from within to the housing 14 to the outside of the housing 14, and vice versa. The housing 14 and the work surfaces 16A, 16B can be formed from suitable materials, such as plastic, metal, coated metal, etc. The housing 14 and the work surfaces 16A, 16B can include a reinforcing framework or reinforcing ribs formed from the same or different material to provide additional strength and load capacity. The reinforcing framework or ribs can be formed throughout the work surface 16A, 16B or only in areas adjacent to the pivot points.

The work surface housing 14 and/or the work surfaces 16A-16E can include a one or more stop devices that prevent the work surfaces from over-rotating, limit an amount of rotation of the work surfaces, limit or restrict a direction of rotation for deploying the work surface from the housing, or limit or restrict a direction of rotation for returning the work surface to the stored position within the housing, to predetermined directions (e.g. clockwise or counterclockwise when viewed from above). The work surfaces 16A, 16B can rotate or pivot in the same direction or in different directions.

The work surfaces 16A, 16B can have a solid surface or a perforated surface for reducing a weight of the work surfaces. The work surfaces 16A, 16B can include smooth or textured surfaces. One or more surfaces or sides of the work surfaces 16A, 16B can include one or more openings, such as slots, perforations, etc., one or more notches or grooves, or one or more deployable features, such as on-board deployable devices that pivotally or translatably deploy from the work surfaces 16A, 16B, for example, for directly hanging laundry thereon or for hanging hangers for supporting laundry.

The work surface 16A, 16B can include an integral handle, for example formed in a front face of the work surface 16A, 16B when the work surface is in the stored position, such that the consumer can grasp the handle to deploy the work surface. Alternatively, the consumer can apply a pushing force on only one side of the front face of the work surface 16A, 16B when the work surface is in the stored position, such that the work surface pivots about the pivot point and deploys from within the housing. In yet another embodiment, the work surface 16A, 16B can include a push release, or push to release, mechanism, such as a spring loaded push release mechanism. In this case, the consumer can press or push inward on the front face of the work surface 16A, 16B when the work surface is in the stored position within the housing 14, thereby disengaging the push release and causing the work surface to deploy from the stored position.

Other exemplary embodiments of the work surface housing 14 and work surface 16A, 16B will be described with reference to FIGS. 6-14H.

Figure 6:
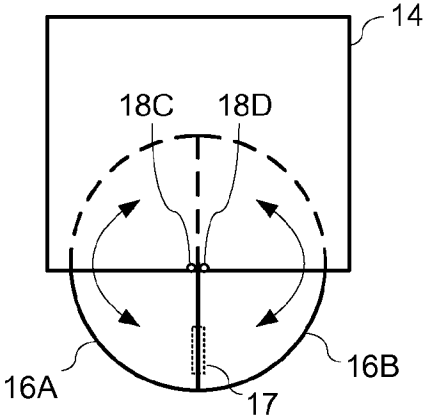
FIG. 6 is a top plan view of a pair of stacked household appliances having a quarter-circle pivotally-deployable work surface according to an exemplary embodiment of the invention.

As shown in FIG. 6, another embodiment of the work surface housing 16 can include one or more pivotally-deployable work surfaces 16A, 16B that pivot or rotate from a stored position within the housing 16 to a deployed position outside of the housing 16. The work surfaces 16A, 16B can pivot or rotate about pivot points 18C, 18D that are located at a central location of the housing 16 and adjacent to a front surface of the housing 14 and appliance 10A, 10B. In this manner, the work surfaces 16A, 16B can be rotated or pivoted from the stored position within the housing 14 to a deployed position outside of the housing 14 and can cooperate to form a single, curved (e.g., half-circle shaped) work surface (16A, 16B). The work surfaces 16A, 16B can include one or more securing devices, such as a latch device, lock device, or clamp device that secures the work surfaces together in the deployed position, thereby improving the stability of the work surface 16A, 16B and preventing the work surfaces from pivoting back into the stored position or a partially stored position.

Figure 8:
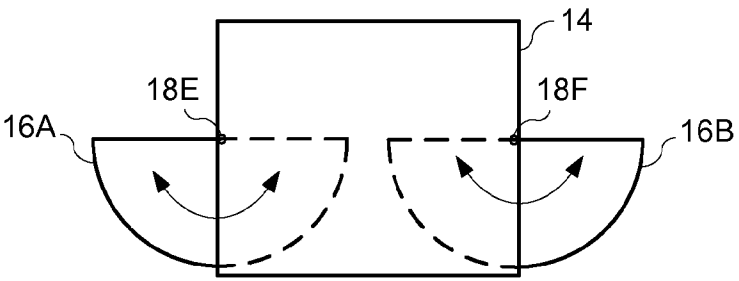
FIG. 8 is a top plan view of a household appliance having a half-circle pivotally-deployable work surface according to an exemplary embodiment of the invention.
Figure 7:
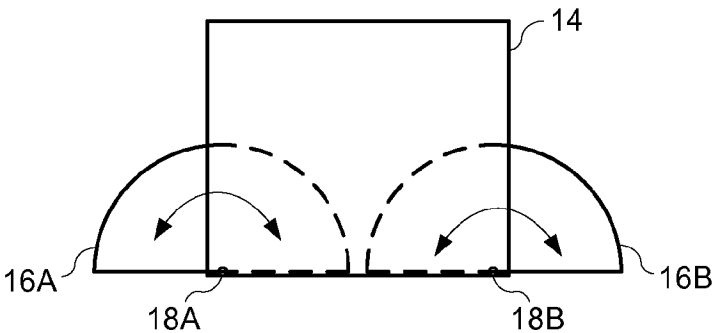
FIG. 7 is a top plan view of a household appliance having a quarter-circle pivotally-deployable work surface according to an exemplary embodiment of the invention.

As shown in FIGS. 7 and 8, other embodiments of the work surface housing 16 can include one or more pivotally-deployable work surfaces 16A, 16B that pivot or rotate from a stored position within a side of the housing 16 to a deployed position outside of the housing 16. The work surfaces can be deployed from the sides of the housing 14, which may correspond to the sides of the laundry appliances 10A, 10B. In this manner, the work surfaces 16A, 16B can be rotated or pivoted from the stored position within the housing 14 to a deployed position outside of the housing 14 along one or more sides of the laundry appliances 10A, 10B. In this manner, the exemplary embodiment can provide additional work surface area along one or more sides of a laundry appliance 10A, 10B without interfering or encumbering a consumer's access to the front of the laundry appliance 10A, 10B.

For example, as shown in FIG. 7, the work surfaces 16A, 16B can pivot or rotate about pivot points 18A, 18B that are located at a central location of the housing 16 and adjacent to a front surface of the housing 14 and appliance 10A, 10B. As shown in FIG. 8, the work surfaces 16A, 16B can pivot or rotate about pivot points 18E, 18F that are located at a central location of the housing 16 (from front to back) and adjacent to a side surface of the housing 14 and appliance 10A, 10B. The exemplary embodiment of FIGS. 5 and 6 also can be configured to be deployed from a side surface of the work surface housing 14.

Figure 10:
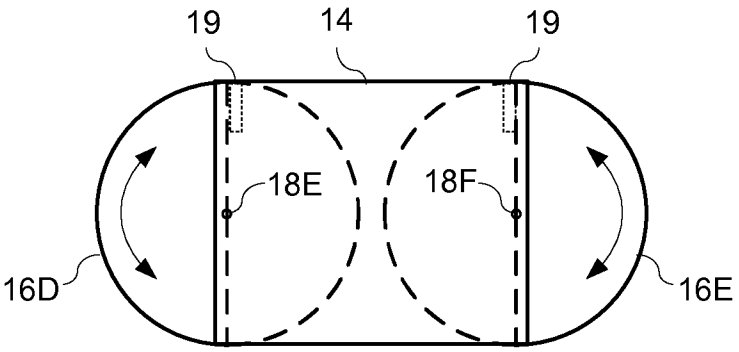
FIG. 10 is a top plan view of a household appliance having a pivotally-deployable work surface according to an exemplary embodiment of the invention.
Figure 9:
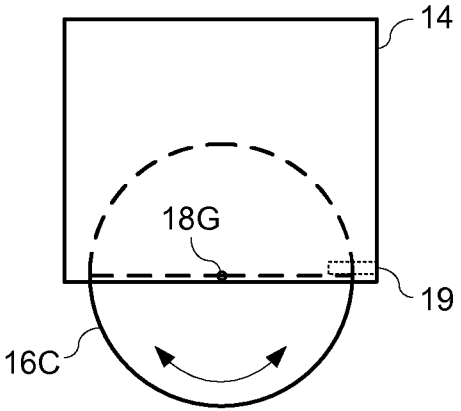
FIG. 9 is a top plan view of a household appliance having a half-circle pivotally-deployable work surface according to an exemplary embodiment of the invention.

As shown in FIGS. 9 and 10, other embodiments of the work surface housing 16 can include a single, half-circle shaped (when viewed from above) pivotally-deployable work surface 16C, 16D, 16E that pivots or rotates from a stored position within a front or a side of the housing 16 to a deployed position outside of the housing 16.

For example, as shown in FIG. 9, the work surface 16C can pivot or rotate about a pivot point 18G that is located at a central location of the housing 16 and adjacent to a front surface of the housing 14 and appliance 10A, 10B. As shown in FIG. 10, the work surfaces 16D, 16E can pivot or rotate about pivot points 18E, 18F that are located at a central location of the housing 16 (from front to back) and adjacent to a side surface of the housing 14 and appliance 10A, 10B. In this manner, the work surfaces 16C, 16D, 16E can be rotated or pivoted from the stored position within the housing 14 to a deployed position outside of the housing 14 along one or more of the front and sides of the laundry appliances 10A, 10B, thereby forming a single, half-circle shaped work surface when viewed from above.

The work surface housing 14 and/or the work surfaces 16A-16E can include a stop device 19 that prevents the work surfaces from over-rotating, limits an amount of rotation of the work surfaces, limits or restricts a direction of rotation for deploying the work surface from the housing, or limits or restricts a direction of rotation for returning the work surface to the stored position within the housing, to predetermined directions (e.g. clockwise or counterclockwise when viewed from above).

Figure 11:
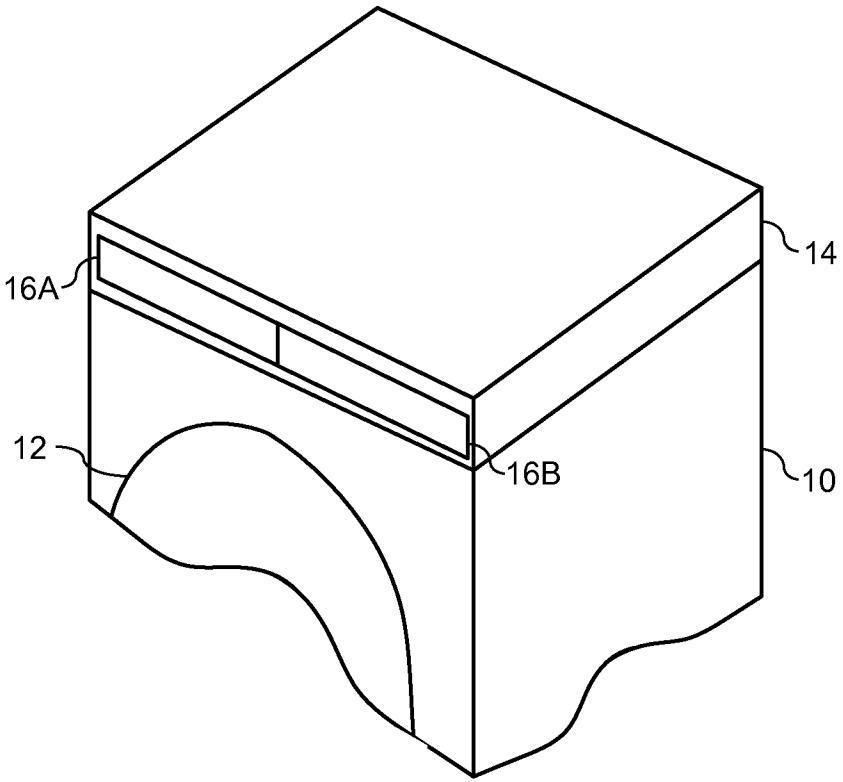
FIG. 11 is a top plan view of a household appliance having a pivotally-deployable work surface according to an exemplary embodiment of the invention.
Figure 12:
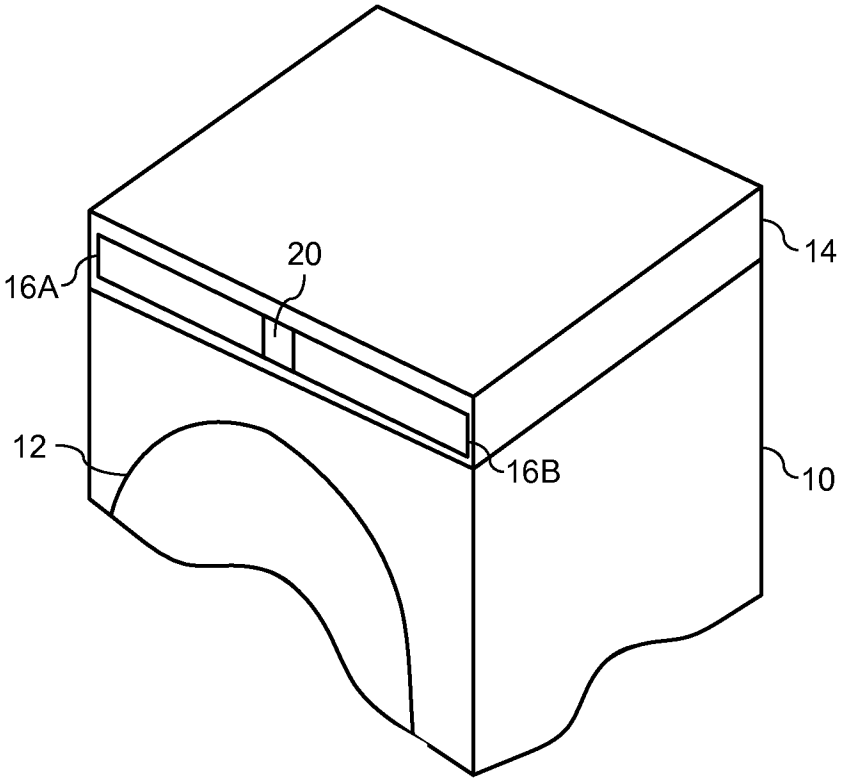
FIG. 12 is a front perspective view of a household appliance having a pivotally-deployable work surface according to an exemplary embodiment of the invention.
Figure 13:
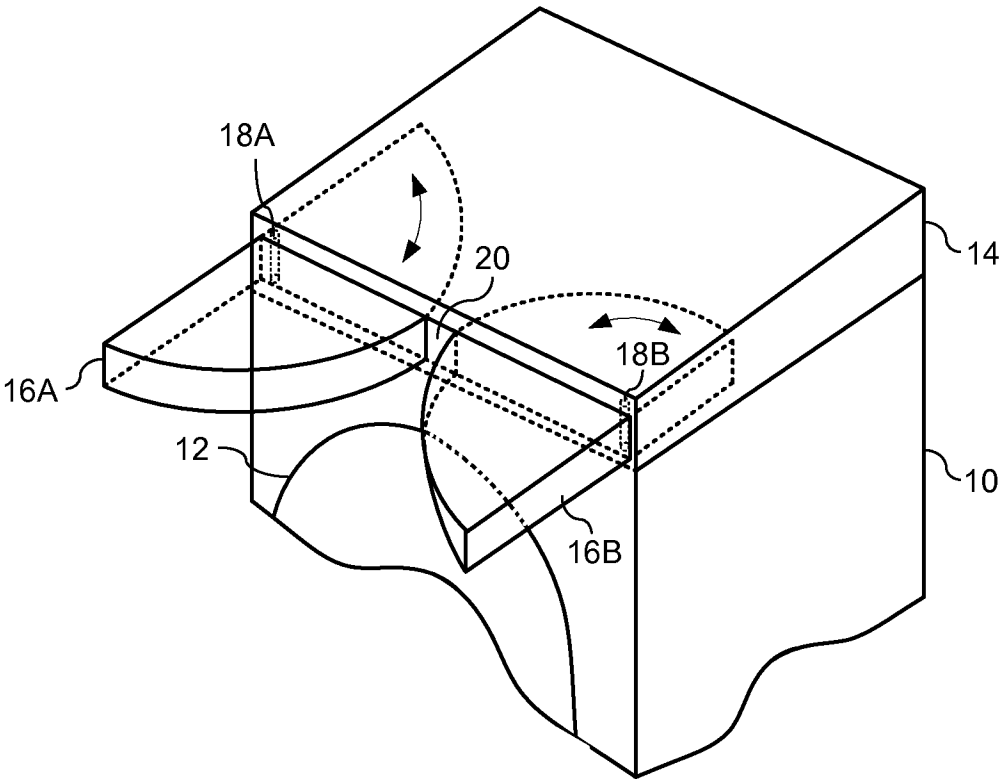
FIG. 13 is a front perspective view of a household appliance having a pivotally-deployable work surface according to an exemplary embodiment of the invention.

FIGS. 11-13 illustrate exemplary embodiments of the work surface housing 14 of FIG. 5. As shown in FIG. 11, the pivotally-deployable work surfaces 16A, 16B can be stored in a flush position with a front surface of the work surface housing 14. The edges of the work surfaces 16A, 16B can be directly adjacent to each other when the work surfaces are in the stored position. In other embodiments, as illustrated for example in FIG. 12, the work surfaces 16A, 16B can be separated from each other by a separating portion or divider 20 formed in the front surface of the housing 14. The size of the separating portion or divider 20 can be configured to provide a predetermined amount of clearance between the opposing work surfaces 16A, 16B when the work surfaces are deployed, thereby providing a predetermined amount of access area or clearance between the work surfaces in front of the laundry appliance for the consumer. In this manner, the exemplary embodiment can provide additional work surface area along the front of a laundry appliance 10A, 10B without interfering or encumbering a consumer's access to the front of the laundry appliance 10A, 10B, or with minimal interference.

As shown in FIG. 13, the work surface housing 14 can be provided on top of the laundry device 10A, 10B. The work surface housing 14 can include one or more pivotally-deployable work surfaces 16A, 16B for increasing the work surface of the appliance. In this manner, a consumer can pivotally-deploy the work surfaces 16A, 16B from the work surface housing 14 to provide additional work surface area, for example, for folding laundry. The consumer can stand in the open area between the curved portions of the work surfaces 16A, 16B, for example, to add or remove laundry through the door 12 of the appliance 10A, 10B.

The pivot points 18A, 18B between the housing 14 and the work surfaces 16A, 16B can be formed by conventional hinges, axles, pins, etc. that permit the work surfaces 16A, 16B to rotate or pivot from within the housing 14 to the outside of the housing 14, and vice versa.

With reference FIGS. 14A-14H, exemplary embodiments of the work surface 16A, 16B will now be described.

The pivotally-deployable work surface 16A, 16B can include one or more means for hanging laundry or hangers. For example, the means for hanging laundry or hangers can include one or more deployable features, such as deployable rods, bars, or the like for hanging clothes, hangers, etc. As shown in FIGS. 14A-14G, the deployable features can include one or more on-board deployable devices (e.g., 22, 42) that pivotally or translatably deploy from within an interior of the work surfaces 16A, 16B, or from a surface of the work surfaces 16A, 16B, for example, for directly hanging laundry thereon or for hanging hangers for supporting laundry. As described in great detail with respect to FIG. 14H, the means for hanging laundry or hangers can include one or more openings, slots, perforations, notches, grooves, or the like (e.g., 40) formed in one or more surfaces or sides of the work surfaces 16A, 16B for receiving an end of a hanger for supporting laundry.

Figure 14B:
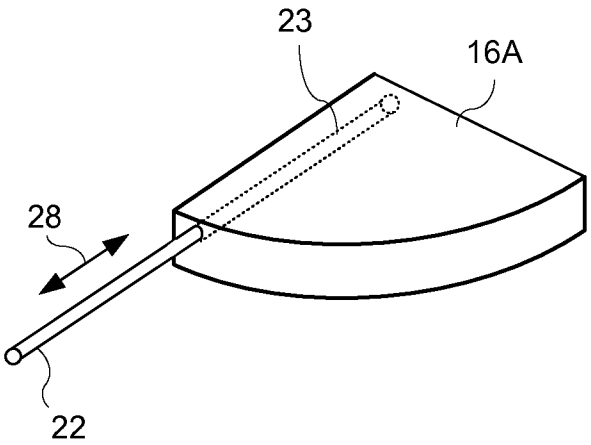
FIGS. 14A-14H are front perspective views of a pivotally-deployable work surface according to an exemplary embodiment of the invention.
Figure 14A:
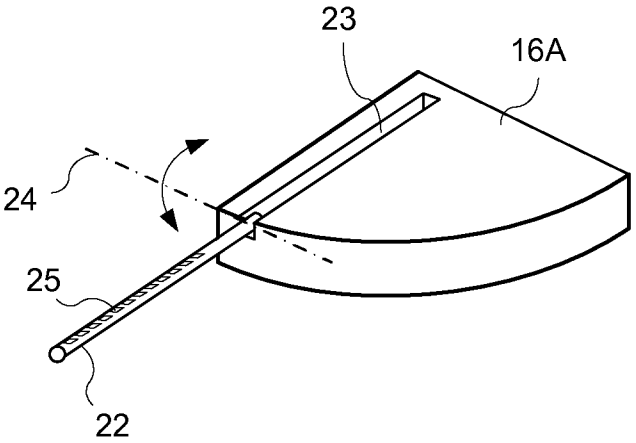

For example, FIG. 14A illustrates an exemplary embodiment of a work surface 16A having a cavity or slot 23 and a rod 22. The rod 22 can be rotatably deployed about an axis 24 from the stored position within the slot 23 to a deployed position outside of the slot 23 after the work surface 16A is deployed from the housing 14. The rod 22 can be stored in a flush or recessed position with respect to an upper surface of the work surface 16A and within the cavity or slot 23. In this manner, the rod 22 can be stored when the work surface 16A, 16B is in the stored position within the housing 14, or when the work surface 16A, 16B is deployed but the consumer does not need the rod 22.

The rod 22 is illustrated as being pivoted into a deployed position that is horizontal to the upper surface of the work surface 16A, 16B. However, in other embodiments, the rod 22 can be deployed into various positions that are not parallel to the upper surface of the work surface 16A, 16B.

In other exemplary embodiments, the rod 22 can be pivotally deployed from a lower surface of the work surface 16A, 16B. In this case, the work surface 16A, 16B and/or the rod 22 can include a securing feature for locking the rod 22 in position.

As shown in FIG. 14B, the rod 22 can be translatably-deployable along a direction 28 from a cavity 23 (shown by dashed lines) formed entirely within the interior of the work surface 16A, 16B, or alternatively, from a groove formed in a surface of the work surface 16A, 16B, similar to FIG. 14A. The rod 22 can be translatably-deployable from a free end of the work surface 16A, 16B, or an edge of the work surface 16A, 16B that is furthest from the laundry appliance.

Figure 14D:
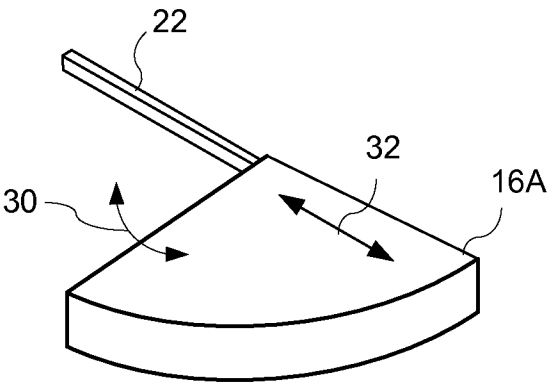
Figure 14C:
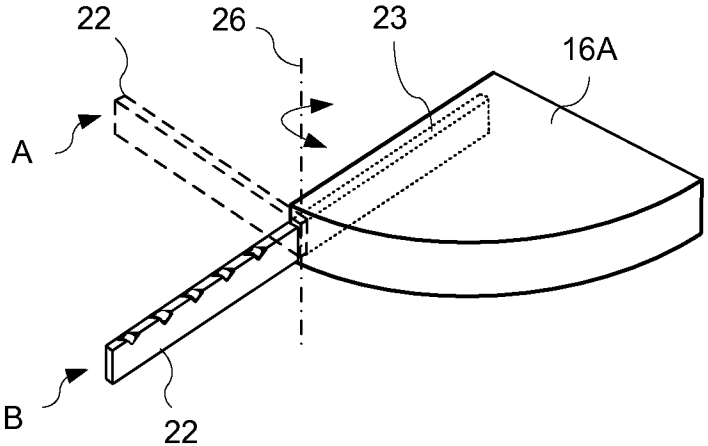

FIG. 14C illustrates an exemplary embodiment of a work surface 16A, 16B having a rod 22 that is pivotably-deployable about an axis 26 from a side surface of the work surface 16A, 16B. The rod 22 can be translatably-deployable from a free end of the work surface 16A, 16B, or an edge of the work surface 16A, 16B that is furthest from the laundry appliance.

As shown in FIG. 14D, the rod 22 can be translatably-deployable along a direction 32 from a cavity (not shown) formed entirely within the interior of the work surface 16A, 16B, or alternatively, from a groove formed in a surface of the work surface 16A, 16B, similar to FIG. 14A. Alternatively, the rod 22 can be pivotally-deployable in a direction 30 from a side surface of the work surface 16A, 16B. In this embodiment, the rod 22 can be translatably-deployable from an edge of the work surface 16A, 16B that is adjacent to or closest to the laundry appliance.

Figure 14F:
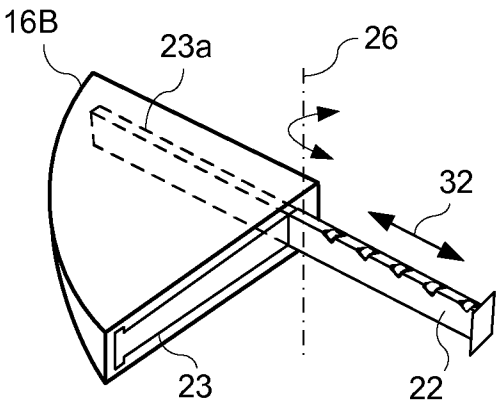
Figure 14E:
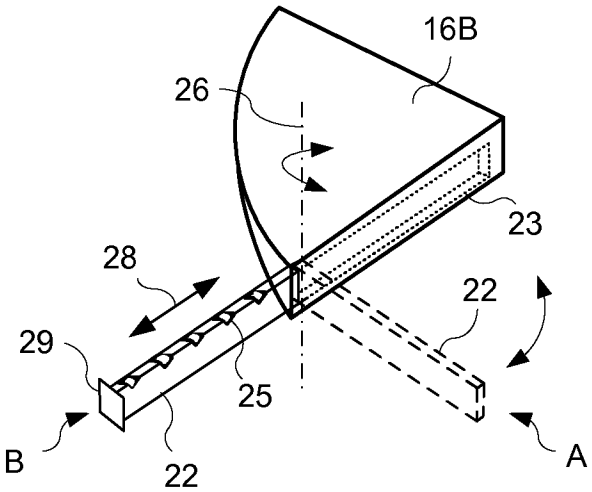

FIG. 14E illustrates another embodiment of a work surface 16A, 16B having a deployable rod 22. The rod 22 can be deployed by pivoting the rod 22 about the axis 26 from a cavity or groove 23, or by translating the rod 22 in a direction 28 from the cavity or groove 23. In this embodiment, the rod 22 can be deployed from a free end of the work surface 16A, 16B, or an edge of the work surface 16A, 16B that is furthest from the laundry appliance.

FIG. 14F illustrates another embodiment of a work surface 16A, 16B having a deployable rod 22. The rod 22 can be deployed by pivoting the rod 22 about the axis 26 from a cavity or groove 23 (shown by dashed lines), or by translating the rod 22 in a direction 32 from the cavity or groove 23. In this embodiment, the rod 22 can be translatably-deployable from an edge of the work surface 16A, 16B that is adjacent to or closest to the laundry appliance.

As shown for example in FIGS. 14C and 14E, the rod 22 can be positioned in a variety of positions, such as a position A (shown by dashed lines) in which the rod can extend in a lateral direction with respect to the front of the laundry appliance to reduce interference with the consumer's access to the laundry appliance, or a position B in which the rod can extend in a transverse direction with respect to the front of the laundry appliance.

As shown in FIGS. 14A, 14C, and 14E, the rod 22 can include one or more openings or notches 25 for receiving and organizing ends of laundry hangers. The rod 22 also can be used to directly hang laundry therefrom. The rod 22 can include an end cap 29 for preventing the hangers or laundry from sliding off of the rod 22.

With reference again to FIGS. 14A-14G, the rod 22 can have various cross-sectional shapes, such as a cylindrical cross-section, a square or rectangular tubular cross-section, a solid bar or solid rod cross-section, a plate-shaped cross-section, etc. The rod 22 also can be formed from a molded shape having a varying cross-section along a length of the rod. The rod 22 can be formed from a variety of suitable materials, such as plastic, metal, or coated metal, or combinations thereof. As shown in FIG. 14G, the rod 22 can have a U-shape such that the bar 22 pivots or folds outward from a side of the work surface 16A, 16B to provide a location for hanging laundry hangers. The U-shaped rod 22 can be stored in a recess or groove formed in a side of the work surface 16A, 16B.

Figure 14H:
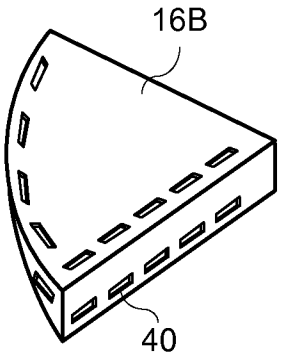
Figure 14G:
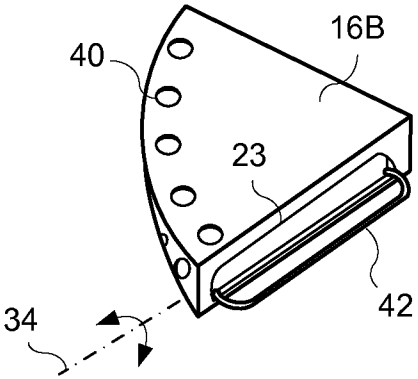

With reference to FIGS. 14G and 14H, the work surface 16A, 16B can include one or more openings, slots, perforations, notches, grooves, or the like (e.g., 40) formed in one or more surfaces or sides of the work surfaces 16A, 16B for receiving an end of a hanger for supporting laundry. For example, as shown in FIG. 14G, an upper surface of the work surface 16A, 16B can include a plurality of openings for receiving ends of laundry hangers. As shown in FIG. 14H, a side surface of the work surface 16A, 16B can include a plurality of openings 40 for receiving ends of laundry hangers.

With reference again to FIGS. 12 and 13, a rod 22 can be deployable directly from the work surface housing 14. For example, a rod 22 can be translatably-deployable from a cavity formed in the divider 20, such that the rod 22 extends in a direction transverse to the front of the laundry appliance and into the clearance area between the work surfaces 16A, 16B.

The rod 22 also can be configured to be pivotably deployable directly from the housing 14. For example, a first portion of the front of the housing 14 can include a pivotably-deployable work surface 16A, 16B, and a second portion of the front of the housing 14 can include a pivotably-deployable rod 22.

The present invention has been described herein in terms of several preferred embodiments. However, modifications and additions to these embodiments will become apparent to those of ordinary skill in the art upon a reading of the foregoing description. Like numbers refer to like elements throughout. In the figures, the thickness of certain lines, layers, components, elements or features may be exaggerated for clarity.

What is claimed is:

1. A work surface device for a domestic household appliance, the work surface device comprising:

a housing having a cavity accessible by an opening formed in a sidewall of the housing and a top surface; and a pivotally-deployable work surface supported by the housing at a pivot point and movable in a horizontal plane about a vertical axis of rotation, wherein the pivotally-deployable work surface is movable in the horizontal plane about the vertical axis of rotation from a stored position within the cavity to a deployed position outside of the housing, and wherein the pivotally-deployable work surface has a planar upper support surface that is arranged parallel to the top surface of the housing.

2. The work surface device of claim 1, wherein the pivot point is adjacent to a corner of the housing of the work surface device.

3. The work surface device of claim 1, wherein the pivot point is disposed substantially at a mid-point along the sidewall of the housing of the work surface device.

4. The work surface device of claim 1, wherein the pivot point is disposed at a point closer to a mid-point along the sidewall of the housing of the work surface device than to a corner of the sidewall of the housing of the work surface device.

5. The work surface device of claim 1, wherein the planar upper support surface of the pivotally-deployable work surface has a quarter-circle shape when viewed from above.

6. The work surface device of claim 1, wherein the planar upper support surface of the pivotally-deployable work surface has a half-circle shape when viewed from above.

7. The work surface device of claim 5, wherein the pivotally-deployable work surface is movable in the horizontal plane about the vertical axis of rotation between an angle of 0 degrees and 90 degrees.

8. The work surface device of claim 6, wherein the pivotally-deployable work surface is movable in the horizontal plane about the vertical axis of rotation between an angle of 0 degrees and 180 degrees.

9. The work surface device of claim 1, wherein the housing has a front sidewall, a rear sidewall, a first sidewall connecting a first end of the front sidewall to a first end of the rear sidewall, and a second sidewall connecting a second end of the front sidewall to a second end of the rear sidewall, and wherein the opening is formed in the front sidewall of the housing.

10. The work surface device of claim 1, wherein the housing has a front sidewall, a rear sidewall, a first sidewall connecting a first end of the front sidewall to a first end of the rear sidewall, and a second sidewall connecting a second end of the front sidewall to a second end of the rear sidewall, and wherein the opening is formed in one of the first sidewall and the second sidewall of the housing.

11. The work surface device of claim 1, wherein the pivotally-deployable work surface includes a secondary deployable feature for hanging items.

12. The work surface device of claim 11, wherein the secondary deployable feature is moveable between a stored position within a cavity of the pivotally-deployable work surface and a deployed position in which a portion of the secondary deployable feature is outside of the cavity of the pivotally-deployable work surface.

13. The work surface device of claim 12, wherein the secondary deployable feature is translatably moveable between the stored position within the cavity of the pivotally-deployable work surface and the deployed position in which the portion of the secondary deployable feature is horizontally disposed outside of the cavity of the pivotally-deployable work surface.

14. The work surface device of claim 12, wherein the secondary deployable feature is moveable about a second pivot point between the stored position within the cavity of the pivotally-deployable work surface and the deployed position in which the portion of the secondary deployable feature is horizontally disposed outside of the cavity of the pivotally-deployable work surface.

15. The work surface device of claim 1, wherein the pivotally-deployable work surface includes secondary deployable means for hanging one of hangers and laundry items from the pivotally-deployable work surface.

16. The work surface device of claim 11, wherein the secondary-deployable feature is deployable from the planar upper support surface of the pivotally-deployable work surface.

17. The work surface device of claim 11, wherein the secondary deployable feature is deployable from a sidewall of the pivotally-deployable work surface.

18. The work surface device of claim 11, wherein the secondary deployable feature includes one of an opening and a notch for receiving an end of a laundry hanger.

19. The work surface device of claim 11, wherein the secondary deployable feature includes an end cap for preventing one of laundry items and a laundry hanger from sliding off of the deployable feature.

20. The work surface device of claim 1, wherein the planar upper support surface has a continuous smooth surface.

21. The work surface device of claim 1, wherein the planar upper support surface has a one of a textured surface and a perforated surface.

22. The work surface device of claim 1, wherein the housing includes a push release mechanism engaging the pivotally-deployable work surface for deploying the pivotally-deployable work surface from the cavity.

23. The work surface device of claim 1, wherein the housing includes a stop device that limits a range of movement of the pivotally-deployable work surface in the horizontal plane about the vertical axis of rotation.

24. The work surface device of claim 1, wherein the pivotally-deployable work surface includes an integral stationary feature for hanging items.

25. The work surface device of claim 24, wherein the integral feature includes an opening formed in one of a sidewall of the pivotally-deployable work surface and the planar upper support surface of the pivotally-deployable work surface.

26. The work surface device of claim 1, further comprising:

a second pivotally-deployable work surface supported by the housing at a second pivot point and movable in the horizontal plane about a second vertical axis of rotation, wherein the second pivotally-deployable work surface has a planar upper support surface that is arranged parallel to the top surface of the housing.

27. The work surface device of claim 26, wherein the second pivotally-deployable work surface is movable in the horizontal plane about the second vertical axis of rotation from a stored position within the cavity to a deployed position outside of the housing.

28. The work surface device of claim 27, wherein an end of a sidewall of the second pivotally-deployable work surface is directly adjacent to an end of a sidewall of the pivotally-deployable work surface when the second pivotally-deployable work surface is in the stored position and the pivotally-deployable work surface is in the stored position.

29. The work surface device of claim 26, wherein the second pivotally-deployable work surface is movable in the horizontal plane about the second vertical axis of rotation from a stored position within the cavity accessible by a second opening formed in the housing to a deployed position outside of the housing.

30. The work surface device of claim 29, further comprising:

a separating portion formed in the sidewall of the housing between the opening and the second opening, wherein the separating portion separates an end of a sidewall of the second pivotally-deployable work surface from an end of a sidewall of the pivotally-deployable work surface when the second pivotally-deployable work surface is in the stored position and the pivotally-deployable work surface is in the stored position.

31. The work surface device of claim 30, wherein the separating portion includes a deployable feature for hanging items.

32. The work surface device of claim 29, wherein the opening and the second opening are formed in the sidewall of the housing of the work surface device.

33. The work surface device of claim 29, wherein the second opening is formed in a second sidewall of the housing of the work surface device, and wherein the second sidewall of the housing of the work surface device is different than the sidewall of the housing of the work surface device.

34. The work surface device of claim 26, wherein the pivot point is adjacent to a first corner of the housing of the work surface device, and wherein the second pivot point is adjacent to a second corner of the housing of the work surface device, the first corner being different than the second corner.

35. The work surface device of claim 26, wherein each of the pivot point and the second pivot point is disposed closer to a mid-point along the sidewall of the housing of the work surface device than to a corner of the sidewall of the housing of the work surface device.

36. The work surface device of claim 26, wherein each of the planar upper support surface of the pivotally-deployable work surface and the second planar upper support surface of the second pivotally-deployable work surface has a quarter-circle shape when viewed from above.

37. The work surface device of claim 26, wherein each of the planar upper support surface of the pivotally-deployable work surface and the second planar upper support surface of the second pivotally-deployable work surface has a half-circle shape when viewed from above.

38. The work surface device of claim 26, wherein the pivotally-deployable work surface is movable in the horizontal plane about the vertical axis of rotation between an angle of 0 degrees and 90 degrees, and wherein the second pivotally-deployable work surface is movable in the horizontal plane about the second vertical axis of rotation between an angle of 0 degrees and 90 degrees.

39. The work surface device of claim 26, wherein the pivotally-deployable work surface is movable in the horizontal plane about the vertical axis of rotation between an angle of 0 degrees and 180 degrees, and wherein the second pivotally-deployable work surface is movable in the horizontal plane about the second vertical axis of rotation between an angle of 0 degrees and 180 degrees.

40. The work surface device of claim 26, wherein the second pivotally-deployable work surface includes a second deployable feature for hanging items, and wherein the second deployable feature is moveable between a stored position within a cavity of the second pivotally-deployable work surface and a deployed position in which a portion of the second deployable feature is horizontally disposed outside of the cavity of the second pivotally-deployable work surface.

41. The work surface device of claim 33, further comprising:

a securing device on one of the pivotally-deployable work surface and the second pivotally-deployable work surface that secures the pivotally-deployable work surface to the second pivotally-deployable work surface in the deployed position.

42. A domestic household appliance comprising:

a housing having a door for accessing an interior of the housing; and the work surface device of claim 1.

43. The domestic household appliance of claim 42, wherein the work surface device is disposed on an upper surface of the housing of the household appliance.

44. The domestic household appliance of claim 42, wherein the work surface device is integrally formed with the housing of the household appliance, and wherein the pivotally-deployable work surface is deployable in the horizontal plane from the housing of the household appliance adjacent to an upper edge of a side panel of the housing of the household appliance.

45. The domestic household appliance of claim 42, wherein the work surface device is integrally formed with the housing of the household appliance, and wherein the pivotally-deployable work surface is deployable in the horizontal plane from the housing of the household appliance adjacent to a lower edge of a side panel of the housing of the household appliance.

46. The domestic household appliance of claim 42, wherein the domestic household appliance is one of a laundry appliance and a stackable laundry appliance.

47. The domestic household appliance of claim 45, wherein the domestic household appliance is a stackable dryer.

48. The work surface device of claim 1, wherein the top surface of the housing covers the cavity formed in the housing, and wherein the pivotally-deployable work surface is movable only in the horizontal plane about the vertical axis of rotation from the stored position within the cavity to the deployed position outside of the housing.

49. The work surface device of claim 26, wherein the top surface of the housing covers the cavity formed in the housing, and wherein the second pivotally-deployable work surface is movable only in the horizontal plane about the second vertical axis of rotation from the stored position within the cavity to the deployed position outside of the housing.

50. The work surface device of claim 14, wherein the secondary deployable feature is moveable in a horizontal plane about a vertical axis of rotation between the stored position within the cavity of the pivotally-deployable work surface and the deployed position in which the portion of the secondary deployable feature is horizontally disposed outside of the cavity of the pivotally-deployable work surface.

51. The work surface device of claim 14, wherein the secondary deployable feature is moveable in a vertical plane about a horizontal axis of rotation between the stored position within the cavity of the pivotally-deployable work surface and the deployed position in which the portion of the secondary deployable feature is horizontally disposed outside of the cavity of the pivotally-deployable work surface.

52. The work surface device of claim 40, wherein the second deployable feature is moveable in a horizontal plane about a vertical axis of rotation between the stored position within the cavity of the second pivotally-deployable work surface and the deployed position in which the portion of the second deployable feature is horizontally disposed outside of the cavity of the second pivotally-deployable work surface.

53. The work surface device of claim 40, wherein the second deployable feature is moveable in a vertical plane about a horizontal axis of rotation between the stored position within the cavity of the second pivotally-deployable work surface and the deployed position in which the portion of the second deployable feature is horizontally disposed outside of the cavity of the second pivotally-deployable work surface.

* * * * *